US007752757B2

(12) United States Patent
Salvatore, Jr.

(10) Patent No.: US 7,752,757 B2
(45) Date of Patent: Jul. 13, 2010

(54) SHAVING SYSTEM WITH GAS-GENERATING CELL

(75) Inventor: William A. Salvatore, Jr., Waterford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 315 days.

(21) Appl. No.: 11/972,087

(22) Filed: Jan. 10, 2008

(65) Prior Publication Data

US 2008/0172879 A1 Jul. 24, 2008

Related U.S. Application Data

(60) Provisional application No. 60/881,021, filed on Jan. 18, 2007.

(51) Int. Cl.
*B26B 19/40* (2006.01)
*B26B 19/34* (2006.01)

(52) U.S. Cl. ..... 30/41; 30/535; 30/538

(58) Field of Classification Search ..... 30/41, 30/535, 538; 141/2, 3, 20.5, 21; 222/4
See application file for complete search history.

(56) References Cited

U.S. PATENT DOCUMENTS 2,336,806 A * 12/1943 Schenk et al. ..... 30/41
2,839,224 A * 6/1958 Lipka ..... 222/191
3,853,157 A * 12/1974 Madaio ..... 141/2
4,205,441 A * 6/1980 Turner ..... 30/41.5
4,228,586 A * 10/1980 Thierry ..... 30/41
4,633,585 A * 1/1987 Whitaker et al. ..... 30/41
5,092,041 A 3/1992 Podolsky
5,242,565 A 9/1993 Winsel
5,427,870 A 6/1995 Joshi et al.
5,707,499 A 1/1998 Joshi et al.
6,060,196 A 5/2000 Gordon et al.
6,789,321 B2 * 9/2004 Simms ..... 30/41
6,925,716 B2 * 8/2005 Bressler et al. ..... 30/41

(Continued)

FOREIGN PATENT DOCUMENTS

GB 2432807 A 6/2007

(Continued)

OTHER PUBLICATIONS

Search Report dated Jun. 6, 2008.

*Primary Examiner*—Jason Daniel Prone
*Assistant Examiner*—Jennifer Swinney
(74) *Attorney, Agent, or Firm*—Energizer Personal Care, LLC

(57) ABSTRACT

A shaving system is provided that includes a safety razor that can be selectively connected to a razor holder via a fluid coupling. At least one gas-generating electrochemical cell is disposed in a sealed gas module in the razor holder. The gas module is in fluid communication with a reservoir adapted to contain shaving aid material capable of fluid flow. The reservoir is in the handle or can have a portion in the holder and a portion in the handle of the safety razor. The gas-generating cell is employed to generally continuously pressurize the portion of the shaving aid material disposed in the handle reservoir. During a normal shaving operation a valve arrangement of the handle can be operated enabling the pressurized shaving aid material in the handle reservoir to be deposited on the skin surface of a user.

13 Claims, 3 Drawing Sheets

U.S. PATENT DOCUMENTS

| | | | | |
|---|---|---|---|---|
| 7,043,841 | B2 * | 5/2006 | Franzini et al. | 30/41 |
| 7,121,754 | B2 | 10/2006 | Bressler et al. | |
| 7,614,568 | B2 * | 11/2009 | Joshi et al. | 239/6 |
| 2005/0138814 | A1 * | 6/2005 | Pennella et al. | 30/41 |
| 2008/0016692 | A1 * | 1/2008 | Noble | 30/41.5 |
| 2008/0156391 | A1 * | 7/2008 | Behar | 141/2 |
| 2008/0257447 | A1 * | 10/2008 | Mauger et al. | 141/2 |

FOREIGN PATENT DOCUMENTS

| | | | |
|---|---|---|---|
| WO | 9404106 | | 3/1994 |
| WO | 2004071260 | A2 | 8/2004 |
| WO | 2007110714 | A1 | 10/2007 |

* cited by examiner

SHAVING SYSTEM WITH GAS-GENERATING CELL

CROSS REFERENCE TO RELATED APPLICATIONS

This application claims the benefit of U.S. Provisional Patent application Ser. No. 60/881,021, filed Jan. 18, 2007.

BACKGROUND

1. Technical Field

This invention relates generally to wet shaving devices, and more specifically to shaving systems that incorporate a gas-generating electrochemical cell adapted to cause a shaving aid material to be dispensed during a normal shaving operation.

2. Background Information

Many modern shaving systems include a razor holder that can be a tray or a wall hanger to permit a user to conveniently store a safety razor when not in use. The safety razor typically includes a razor cartridge adapted to be permanently or selectively movably connected to a handle. The cartridge can be adapted for shaving in a single direction or multiple directions, most usually bi-directionally, i.e. in to and fro directions. The cartridge comprises a housing having at least one razor blade with a sharpened cutting edge disposed therein. The cutting edge can be rectilinear or the razor blade can comprise a foil having a plurality of apertures having cutting edges extending at least partially around perimeter thereof.

There have been many proposals to provide a safety razor with a dispensing system for delivering to the skin during shaving a shaving aid material, such as shave foam, shave cream or other lubricating fluid, or skin care materials that cleanse or otherwise care for the skin. The material is stored within a reservoir ready for use. The stored material can replace a customary shaving preparation or can be used in addition thereto. U.S. Pat. No. 7,121,754 to Bressler et al discloses a safety razor that includes a reservoir for storing a shaving aid material and a valve that can be actuated by movement of the razor cartridge between a first position and a second position during a normal shaving operation. The fluid in the reservoir has a pressure differential provided for example by a compression spring acting on a piston. The pressure differential provides the motive force to deliver the fluid to the user's skin surface when the valve is open. U.S. Pat. No. 7,043,841 to Franzini et al and U.S. Patent application publication 2005/0138814 disclose further devices having differentially pressurized fluid reservoirs and further configurations of valves.

Several U.S. Patents to Joshi and Joshi et al including U.S. Pat. No. 5,427,870 disclose devices for dispensing a fluid by a pressure differential provided by an electrochemical gas-generating cell. The '870 patent discloses continuous flow at rates 0.03-2.7 ml per day. For many typical wet shaves (for a male user) it is desirous for about 12 ml or more of some particular shaving aid materials to be dispensed for each shave. Each shave is typically performed over a finite time period of several minutes only.

SUMMARY

The present invention has for its objective to eliminate, or at least substantially alleviate the limitations of the prior art safety razor and combined safety razor and razor holder arrangements having shaving aid dispensing systems. The invention is directed particularly to a shaving system that includes a safety razor with a fluid dispensing system having a reservoir with a pressure differential provided by one or more gas-generating cells. The pressure energy of the generally continuous gas generation of the cell is accumulated within the shaving system to provide sufficient pressure differential to dispense a desired volume of shaving aid material during a normal shaving operation.

One embodiment of the shaving system of the present invention comprises a razor holder and a safety razor. The razor holder has a shell having a gas module in fluid communication with a fluid module, both disposed within the shell. The gas module includes at least one electrochemical gas-generating cell and the fluid module includes a primary reservoir adapted to contain shaving aid material capable of fluid flow. The razor holder also has one half of a fluid coupling, the safety razor having the mating fluid coupling half. The safety razor is selectively connectable to the razor holder and has a handle and a razor cartridge. The handle includes a secondary reservoir adapted to contain the shaving aid material and means to pressurize the shaving aid material. When the razor is connected to the holder the fluid module is in fluid communication with the secondary reservoir. In this manner, gas generated by the gas-generating cell pressurizes the primary reservoir of the fluid module to cause shaving aid material to flow to the secondary reservoir of the handle and accumulate therein when the safety razor is connected to the razor holder. During a normal shaving operation, when the razor is removed from the holder, valve means of the handle can be actuated enabling the pressurized shaving aid material in the secondary reservoir to be deposited on the skin surface of the user.

In a further embodiment, a shaving system of the present invention comprises a razor holder and a safety razor. The razor holder has a shell having a gas module disposed within the shell. The gas module includes at least one electrochemical gas-generating cell. The razor holder also has one half of a fluid coupling, the safety razor having the mating fluid coupling half. The safety razor is selectively connectable to the razor holder and has a handle and a razor cartridge. The handle includes a handle reservoir adapted to contain shaving aid material and means to pressurize the shaving aid material. When the razor is connected to the holder, the gas module is in fluid communication with a shaving aid material pressurizing means of the handle. In this manner, gas generated by the gas-generating cell increasingly pressurizes the shaving aid material in the handle reservoir. During a normal shaving operation, when the razor is removed from the holder, valve means of the handle can be actuated enabling the pressurized shaving aid material in the handle reservoir to be deposited on the skin surface of the user.

The above features and advantages of the present invention will be more fully understood with reference to the following detailed description when taken in conjunction with the accompanying drawings.

DETAILED DESCRIPTION

Figure 1:
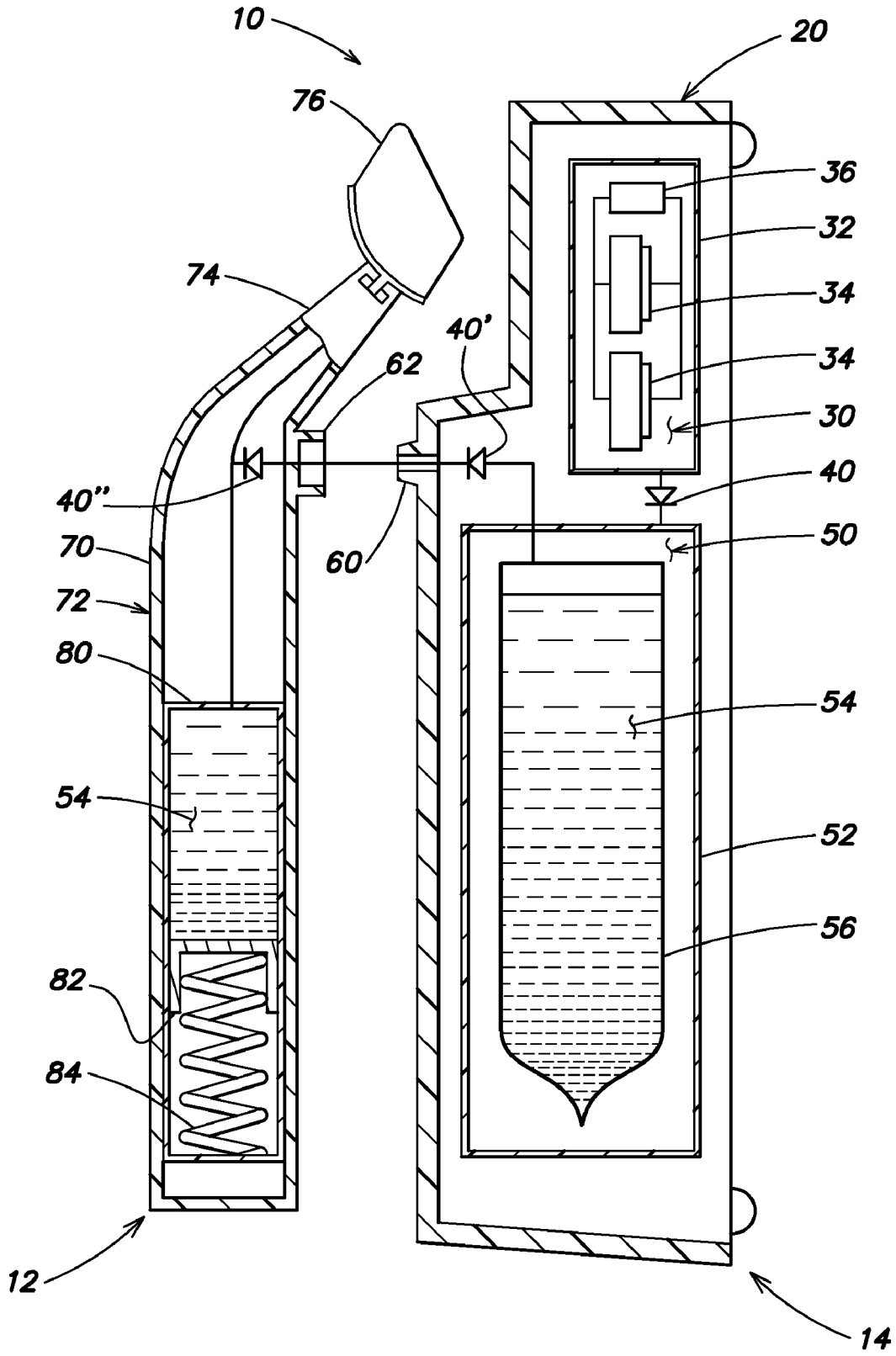
FIG. 1 is a combined sectional/schematic view of an embodiment of a shaving system of present invention.
Figure 2:
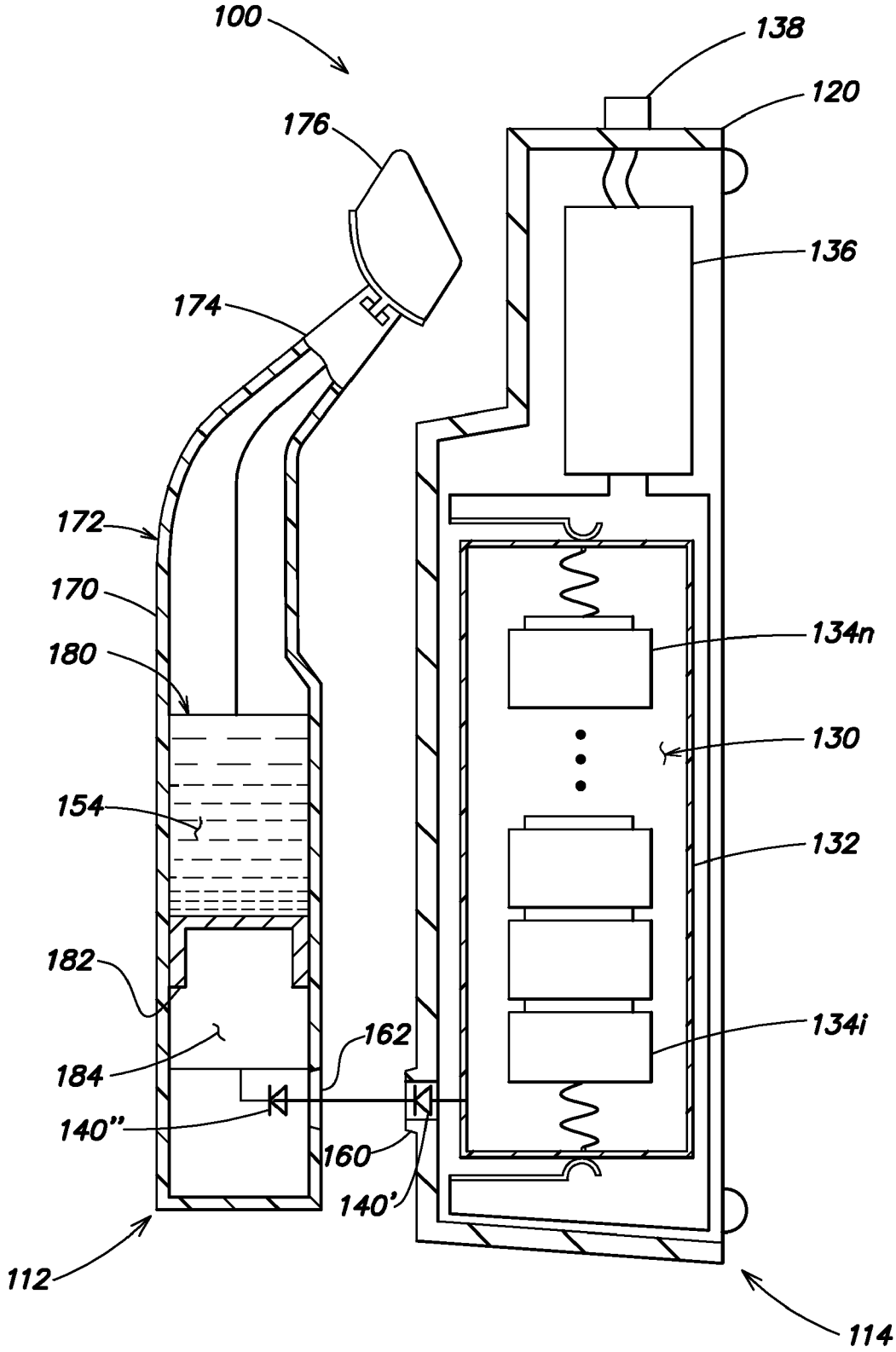
FIG. 2 is a combined sectional/schematic view of another embodiment of a shaving system of present invention.
Figure 3:
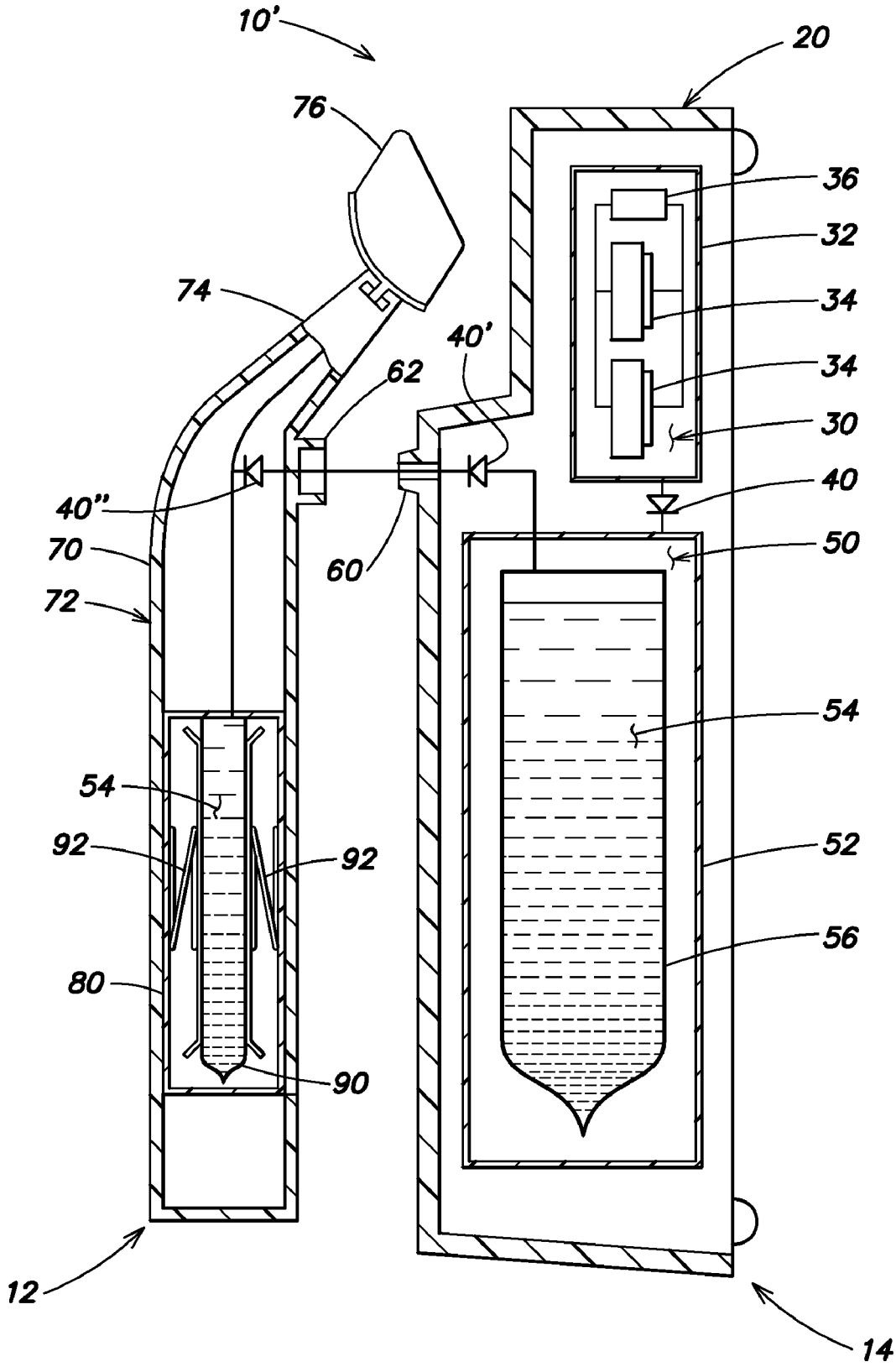
FIG. 3 is a combined sectional/schematic view of a further embodiment of a shaving system of present invention.

Referring to FIGS. 1 and 3, exemplary embodiments of a shaving system of the present invention are depicted. The shaving system 10, 10' comprises a safety razor 12 selectively connectable to a razor holder 14. The razor holder can be adapted for use on a generally horizontal surface, as such the razor holder is conventionally known as a razor tray. The razor holder can also be adapted for use on a generally vertical surface, as such the razor holder is conventionally known as a wall holder or caddy. Purely for convenience of illustration the razor 12 is depicted spaced away slightly from its nested position on the razor holder 14. The razor holder comprises a molded shell, 20, preferably manufactured from ABS or other suitable thermoplastic. The shell contains a gas module 30 comprising a sealed housing 32 containing at least one gas-generating electrochemical cell 34. In the embodiment depicted, two (2) gas-generating cells are depicted, electrically connected in parallel to a suitable load resistor 36. Well known gas-generating cells are disclosed for example in U.S. Pat. No. 5,242,565 to Winsel, U.S. Pat. Nos. 5,427,870 and 5,707,499 to Joshi et al and U.S. Pat. No. 6,060,196 to Gordon et al. The load resistor 36 can have a value in the range about 1000 Ohms to 10000 Ohms or more and is selected to provide a desired gas discharge rate from the cell or cells. The load resistor can be within or external to the gas module. The razor holder can optionally be provided with a user-operable switch or push-button (138 as depicted in FIG. 2), the switch or push-button being electrically connected to the gas module 30 to provide further control of the flow of gas from the gas-generating cell(s) or to allow the user to selectively terminate flow of gas during extended periods of non-use. The gas module 30 is in fluid (gaseous) communication with a fluid module 50 preferably via a one-way valve 40. Purely for convenience of illustration, each of FIGS. 1-3 depicts fluid communication paths as these would be represented in a circuit diagram. One of skill in the art would understand the single lines depicted to represent a fluid communication path would be replaced by e.g. a length of tube or other fluid coupling in any physical embodiment of the present invention. The fluid module 50 comprises a sealed housing 52 containing a portion of a shaving aid material 54 contained within a primary reservoir that is preferably a flexible pouch 56. The shaving aid material can also be contained in other reservoir means as are well known in the art, for example a rigid cylinder, and the present invention is not limited in regard to the container for the shaving aid material. The shaving aid material is preferably a liquid or any other material capable of fluid flow such as a cream or gel, etc. A wide variety of shaving aid materials can be applied to the skin during shaving using a shaving system in accordance with the present invention, including materials exhibiting the properties or qualities or any one or more of the following: (i) shaving soap; (ii) lubricant; (iii) skin conditioner; (iv) skin moisturizer; (v) hair softener or conditioner to facilitate cutting; (vi) fragrance; (vii) skin cleanser; (viii) bacterial or medicinal lotion; (ix) depilatory agent; and (x) blood coagulant or the like for beneficial treatment of minor cuts and abrasions which can be suffered during shaving. While certain shaving aid materials have been described, the present invention is not limited in this regard as materials known to those skilled in the art to which the present invention pertains can be substituted without departing from the broader aspects of the present invention.

The pouch 56 is in fluid communication with an outlet port 60 that includes one part or half of a fluid coupling as is well known in the art. The fluid coupling is preferably the push-in type.

The safety razor 12 comprises a handle 70 having a body portion 72 and a head portion 74. A razor cartridge 76 is movably connected to the head portion. The handle has an inlet port 62 that includes the mating part or half of the fluid coupling previously described. Each half or part of the holder-to-razor fluid coupling is preferably provided with a one-way valve 40', 40" of the type opened only when the fluid coupling 60, 62 is mated, i.e. when the razor 12 is connected to the razor holder 14. The one-way valves 40', 40" prevent the shaving aid material from undesirably flowing from the reservoirs of one or both the handle and holder when the razor is removed from the holder, for instance for normal use. The handle includes a preferably cylindrical secondary reservoir 80 adapted to contain a further portion of the shaving aid material 54. The reservoir has a piston 82, slidable along substantially the entire length of the reservoir and an energy storing device, such as a compression spring 84, that in combination act to apply pressure to the shaving aid material within reservoir 80. The secondary reservoir of the handle can also comprise a flexible pouch 90 as depicted in FIG. 3 having energy storing devices that can include one or more springs, e.g. leaf springs or compression springs 92 acting directly or indirectly on one or both side walls of the pouch. The secondary reservoir is in fluid communication with the head portion 74 of the handle 70. The head portion 74 includes a valve or valves for example as disclosed U.S. Pat. No. 7,121,754 to Bressler et al, U.S. Pat. No. 7,043,841 to Franzini et al and U.S. Patent application publication 2005/0138814. The disclosures of the aforementioned publications are hereby incorporated in their entirety for reference. The present invention is not limited in regard to the specific construction of the valve or valves as valves known to those skilled in the art to which the present invention pertains can be substituted without departing from the broader aspects of the present invention. The valve or valves permit the shaving aid fluid to flow from the secondary reservoir to the skin surface of a user during a normal shaving operation in response to forces applied to the razor cartridge.

In operation the gas-generating cell(s) 34, when in electrical connection to the suitable load resistor 36, produce gas at a rate about 0.03-20 ml or more per day per cell. This gas pressurizes the sealed housing 32 of the gas module 30. The pressurized gas flows to the fluid module 50 via the one-way valve 40. The gas pressurizes the sealed housing 52 of the fluid module 50 and in turn externally pressurizes the flexible pouch 56 of the primary reservoir. The pressure applied to the outside of the pouch pressurizes the shaving aid material within the pouch. When the razor 12 is connected to the razor holder 14 the pressurized shaving aid material flows from the pouch 56 to the secondary reservoir 80, 90 of the handle via the coupling 60, 62. When the shaving aid material flows into the reservoir 80 this causes the piston 82 to move in a downward direction relative to the printed page depicting FIG. 1, compressing the spring 84 or otherwise storing energy. When the razor is removed from the razor holder, for example when being used for a normal shaving operation, one-way valve 40' is closed by disconnection of the coupling 60, 62 interrupting the flow of shaving aid material from the pouch of the primary reservoir. In normal shaving, the valve or valves of the head portion are actuated permitting the shaving aid material to flow from the secondary reservoir, under pressure caused by an application of force by the energy storing device.

In the manner previously described, the relatively low volume but generally continuous gas generation of the cells can be accumulated when the razor is not in normal use. In normal use, which can be over a very short period compared to the non-use period, the accumulated pressure can propel a desired volume of the shaving aid material to the skin surface of the user.

Referring now to FIG. 2, another embodiment of a shaving system is depicted. The shaving system 100 comprises a safety razor 112 connectable to a razor holder 114. As previously described, purely for convenience of illustration the razor 112 is depicted spaced away slightly from its nested position on the razor holder 114. The razor holder comprises a molded shell, 120, preferably manufactured from ABS or other suitable thermoplastic. The shell contains a gas module 130 comprising a sealed housing 132 containing at least one gas-generating electrochemical cell **134*i*-134*n*, as previously described. In the embodiment depicted, the gas-generating cells are electrically connected in series. The gas module is electrically connected to a control module 136 that includes a suitable load resistor, as previously described, and can optionally include well known timing or modulating devices to further control the flow of gas from the gas-generating cell(s). The razor holder is also preferably provided with a user-operable switch or push-button 138** electrically connected to the control module to provide still further control of the flow of gas from the gas-generating cell(s).

The safety razor 112 comprises a handle 170 having a body portion 172 and a head portion 174. A razor cartridge 176 is connected to the head portion. The razor holder and the razor are provided with a fluid coupling 160, 162 respectively, preferably including one-way valves 140', 140" as previously described. The handle includes a preferably cylindrical reservoir 180 having a gas accumulating portion 184 and a portion adapted to contain a portion of a shaving aid material 154, as previously described. The reservoir has a piston 182, slidable along the reservoir separating the gas accumulating portion and the shaving aid material containing portion. The shaving aid material containing portion of the reservoir is in fluid communication with the head portion of the handle 174. The head portion 174 includes a valve or valves as previously described.

When the razor is connected to the razor holder, the gas module 130 is in fluid (gaseous) communication with a gas accumulating portion of a reservoir 184 via the fluid coupling 160, 162. In operation, the gas-generating cells **134*i*-134*n*, when in electrical connection through the load resistor of the control module, produce gas at a rate previously described. The gas flows from the gas module 130 and pressurizes the gas accumulating portion of the reservoir of the razor handle 184. When the razor is removed from the razor holder, for example when being used for a normal shaving operation, one-way valves 140', 140" are closed by disconnection of the coupling 160, 162**. In normal shaving, the valve or valves of the head portion of the handle, as previously described, are actuated permitting the shaving aid material to flow from the reservoir, under pressure of the gas in the gas accumulating portion of the reservoir acting against the slidable piston. In this manner the relatively low volume but generally continuous gas generation of the cells can be accumulated when the razor is not in normal use. In normal use, which can be over a very short period compared to the non-use period, the accumulated pressure can propel a desired volume of the shaving aid material to the skin surface of the user.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. For instance, features disclosed in connection with any one embodiment can be used alone or in combination with each feature of the respective other embodiments. Those skilled in the art will further recognize that variations and modifications can be made within the scope of the invention. For instance, one of the sealed housing of the fluid module and the primary reservoir therein may be adapted to be exchanged by a user when the contents of the primary reservoir are sufficiently depleted. The primary reservoir may be adapted to be selectively refillable by a user when its contents are sufficiently depleted. The gas module may be adapted to be exchanged by a user when the gas-generating cells therein are sufficiently depleted.

What is claimed is:

1. A shaving system, comprising:

a razor holder, the razor holder comprising: a shell having a gas module and a fluid module disposed therein and one half of a fluid coupling; wherein the gas module includes at least one electrochemical gas-generating cell; and wherein the fluid module includes a primary reservoir adapted to contain a first portion of a shaving aid material capable of fluid flow; and a safety razor selectively connectable to the razor holder, the safety razor comprising: a handle and a razor cartridge, wherein the handle comprises: a secondary reservoir adapted to contain a second portion of the shaving aid material, means to pressurize the shaving aid material and a mating half of the fluid coupling;

wherein the gas module is in fluid communication with the fluid module, wherein the primary reservoir is in fluid communication with the secondary reservoir when the safety razor is connected to the razor holder, and wherein the safety razor includes means to deposit the shaving aid material on a skin surface of a user during a normal shaving operation.

2. The shaving system of claim 1, wherein the primary reservoir contains the first portion of the shaving aid material.

3. The shaving system of claim 1, wherein each half of the fluid coupling includes a one-way valve, each valve being adapted to terminate fluid flow from the respective coupling half when the safety razor is removed from the razor holder.

4. The shaving system of claim 1, wherein the primary reservoir comprises a flexible pouch.

5. The shaving system of claim 1, wherein the gas module includes a load resistor in electrical connection to the at least one electrochemical gas-generating cell.

6. The shaving system of claim 1, wherein the fluid communication connection between the gas module and the fluid module gas module includes a one-way valve.

7. The shaving system of claim 1, wherein the secondary reservoir comprises a rigid cylinder.

8. The shaving system of claim 1, wherein the secondary reservoir comprises a flexible pouch.

9. A shaving system, comprising:

a razor holder, the razor holder comprising: a shell having a gas module and one half of a fluid coupling; wherein the gas module includes at least one electrochemical gas-generating cell; and a safety razor selectively connectable to the razor holder, the safety razor comprising: a handle and a razor cartridge, wherein the handle comprises: a handle reservoir adapted to contain a portion of a shaving aid material capable of fluid flow; means to pressurize the shaving aid material and a mating half of the fluid coupling;

wherein the gas module is in fluid communication with the shaving aid material pressurizing means of the safety razor when the safety razor is connected to the razor holder, and wherein the safety razor includes means to deposit the shaving aid material on a skin surface of a user during a normal shaving operation.

10. The shaving system of claim 9, wherein the handle reservoir contains the portion of the shaving aid material.

11. The shaving system of claim 9, wherein each half of the fluid coupling includes a one-way valve, each valve being adapted to terminate fluid flow from the respective coupling half when the safety razor is removed from the razor holder.

12. The shaving system of claim 9, wherein the gas module includes a load resistor in electrical connection to the at least one electrochemical gas-generating cell.

13. The shaving system of claim 9, wherein the handle reservoir comprises a rigid cylinder.

* * * * *

UNITED STATES PATENT AND TRADEMARK OFFICE

CERTIFICATE OF CORRECTION

PATENT NO. : 7,752,757 B2
APPLICATION NO. : 11/972087
DATED : July 13, 2010
INVENTOR(S) : William A. Salvatore, Jr.

It is certified that error appears in the above-identified patent and that said Letters Patent is hereby corrected as shown below:

Title page; section (75) "Inventor:"
Please delete inventor residence "Waterford, CT (US)" and substitute -- Watertown, CT (US) --.

Signed and Sealed this

Twenty-fourth Day of August, 2010

David J. Kappos

David J. Kappos
*Director of the United States Patent and Trademark Office*